United States Patent [19]

Motosugi et al.

[11] Patent Number: 4,571,605

[45] Date of Patent: Feb. 18, 1986

[54] THERMOSENSITIVE RECORDING MATERIAL

[75] Inventors: Takanori Motosugi; Hisashi Sakai, both of Numazu, Japan

[73] Assignee: Ricoh Company, Ltd, Tokyo, Japan

[21] Appl. No.: 669,890

[22] Filed: Nov. 9, 1984

[30] Foreign Application Priority Data

Dec. 6, 1983 [JP] Japan ..... 58-230243

[51] Int. Cl.[4] ..... B41M 5/22

[52] U.S. Cl. ..... 346/216; 346/217; 346/225; 346/226; 427/150; 427/151; 427/152

[58] Field of Search ..... 346/216, 217, 218, 225, 346/226; 427/150, 151, 152

[56] References Cited

U.S. PATENT DOCUMENTS

| | | | |
|---|---|---|---|
| 4,498,091 | 2/1985 | Yamato et al. | 346/216 |
| 4,502,068 | 2/1985 | Taniguchi et al. | 346/226 |
| 4,506,278 | 3/1985 | Sakamoto et al. | 346/216 |
| 4,511,910 | 4/1985 | Taniguchi et al. | 346/216 |

*Primary Examiner*—Bruce H. Hess

*Attorney, Agent, or Firm*—Oblon, Fisher, Spivak, McClelland & Maier

[57] ABSTRACT

A thermosensitive recording material which comprises a support material and a thermosensitive color-forming layer formed on the support material, comprising a colorless or light-colored leuco dye and a color developer capable of inducing color formation in the leuco dye upon application of heat thereto, is disclosed, in which the color developer is 4-hydroxydimethylphthalate or a first bisphenol derivative of the formula (I)

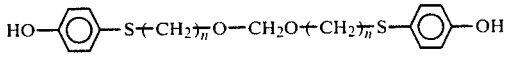

(I)

wherein n is an integer of 1 or 2, and there is interposed between the support material and the thermosensitive color-forming layer an undercoated layer comprising a second bisphenol derivative of the formula (II),

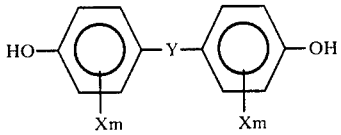

(II)

wherein X represents halogen, Y represents $-SO_2-$ or—

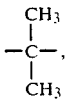

m is an integer of 1 or 2, and the substitution positions of Xm in the benzene rings are symmetrical with respect to Y.

5 Claims, No Drawings

THERMOSENSITIVE RECORDING MATERIAL

BACKGROUND OF THE INVENTION

The present invention relates to an improved thermosensitive recording material, and more particularly to a thermosensitive recording material comprising a support material and a thermosensitive color-forming layer formed on the support material, which thermosensitive color-forming layer comprises a leuco dye which is a colorless or light-colored at room temperature and a color developer capable of inducing color formation in the leuco dye upon application of heat thereto.

Recently thermosensitive recording materials are employed in a variety of fields, for instance, for use with printers of computers, recorders of medical analytical instruments, facsimile apparatus, automatic ticket vending apparatus, and thermosensitive copying apparatus, since they have the following advantages over other recording materials: (1) Images can be formed by simple heat application, without any complicated steps for development; (2) the thermosensitive recording materials can be produced by a simple apparatus and the storage of the thermosensitive recording materials is simple and does not involve excessive costs; (3) as the support material of the thermosensitive recording materials, paper is usually used, which is rather inexpensive in comparison with other support materials, such as synthetic resin films, and when paper is used as the support material, the thermosensitive recording material has a pleasing plain-paper-like touch.

A conventional thermosensitive recording material is produced by coating a support material (for instance, a sheet of paper or a synthetic resin film) with a thermosensitive color-forming layer formation liquid containing a color-forming component and a color developing component which reacts with the color-forming component to form color when heated, and then by drying the liquid to form a thermosensitive color-forming layer.

Images are formed and recorded in the thus produced thermosensitive recording material by application of heat through a thermal pen or head.

Thermosensitive recording materials of the above-described type are disclosed, for instance, in Japanese Patent Publications No. 43-4160 and No. 45-14039.

The conventional thermosensitive recording materials have the shortcomings that they are slow in thermal response, not allowing rapid recording with high image density and high image sharpness.

In order to increase the thermal coloring sensitivity of these thermosensitive recording materials, there have been proposed methods in which a particular thermo-fusible material is added to the thermosensitive color-forming layer, thereby attaining high thermal coloring sensitivity and allowing rapid recording with high image density and high image sharpness.

Examples of such thermo-fusible materials are disclosed, for instance, in the following Japanese laid-open patent applications: nitrogen-containing compounds, such as acetamide, stearamide, m-nitroaniline, and phthalic acid dinitrile in Japanese Laid-Open Patent Application No. 49-38424; acetoacetanilide in Japanese Laid-Open Patent Application No. 52-106746; N,N-diphenylamine derivatives, benzamide derivatives and carbazole derivatives in Japanese Laid-Open Patent Application No. 53-11036; alkylated biphenyls and biphenyl alkanes in Japanese Laid-Open Patent Application No. 53-39139. In Japanese Laid-Open Patent Application No. 56-144193, there are disclosed p-hydroxybenzoic acid ester derivatives which serve as thermo-fusible materials and as color developing materials.

Of the above compounds, p-hydroxy benzoic acid ester derivatives have been considered to be the best to be used as color developer in the thermosensitive color-forming layer of the thermosensitive recording materials.

However, the method of using p-hydroxybenzoic acid derivatives still has the shortcoming that the recorded images fade and white powder or a crystal-like material appears on the surface of the image portions of the thermosensitive recording materials, so that the image portions are whitened.

SUMMARY OF THE INVENTION

It is therefore an object of the present invention to provide an improved thermosensitive recording material from which the above-described shortcomings of the conventional thermosensitive recording materials are eliminated, more specifically, which improved thermosensitive recording material is capable of allowing rapid recording with high image density and high thermal coloring sensitivity, without the fading of recorded image areas and the formation of white powder or crystals on the image areas.

The thermosensitive recording material according to the present invention which can attain the above object comprises a support material and a thermosensitive color-forming layer formed thereon comprising as the main components a leuco dye and a color developer capable of including color formation in the leuco dye when heated, with the key features that as the color developer, 4-hydroxydimethylphthalate or a first bisphenol derivative of the following formula (I) is employed, and there is interposed between the support material and the thermosensitive color-forming layer an under-coated layer comprising a second bisphenol derivative of the following formula (II):

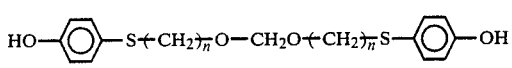

(I)

wherein n is an integer of 1 or 2,

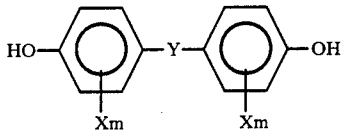

(II)

wherein X represents halogen, Y represents —$SO_2$— or

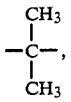

m is an integer of 1 or 2, and the substitution positions of Xm in the benzene rings are symmetrical with respect to Y.

As mentioned above, in the present invention, 4-hydroxydimethylphthalate or the first bisphenol derivative of the above formula (I) is employed as color developer. These compounds exhibit higher color developing performance than do the conventional color developers, such as 4,4'-isopropylidenebisdiphenol and 4,4'-butylidendiphenol. Accordingly these compounds exhibit higher thermal response and are capable of yielding more uniform images than the conventional color developers.

The second bisphenol derivatives of the above general formula (II) have relatively high melting points. However, when the bisphenol derivatives are co-melted with the above-mentioned 4-hydroxydimethylphthalate or the first bisphenol derivatives of the formula (I), the recrystallization of the derivatives in the developed image can be prevented, so that the fading and whitening of the developed image areas can be avoided. However, since the second bisphenol derivatives of the formula (II) have high melting points, they have the shortcoming that as the amount of the bisphenol derivatives to be used together with the leuco dyes is increased, the color-development performance decreased. Furthermore, when the bisphenol derivatives of the formula (II) are employed together with 4-hydroxydimethylphthalate or the first bisphenol derivatives of the formula (I), the water-solubilities of the latter compounds serving as color developers increase. As a result, the fogging of the developed image areas takes place.

In the present invention, however, since the second bisphenol derivatives of the formula (II) are employed in the under-coated layer, the above shortcomings of the bisphenol derivatives can be avoided.

Specific examples of the first bisphenol derivatives of the formula (I) are as follows:

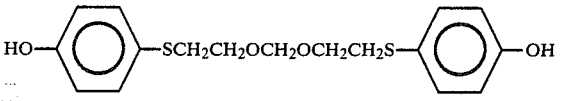

1,7-di(4-hydroxyphenylthio)-3,5-dioxaheptane

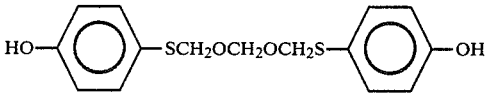

1,5-di(4-hydroxyphenylthio)-2,4-dioxapentane

Specific examples of the second bisphenol derivatives of the formula (II) are as follows:

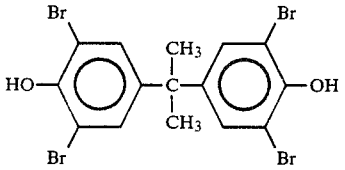

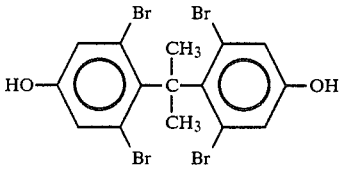

-continued

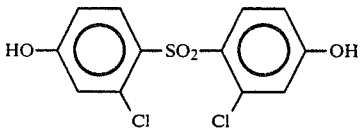

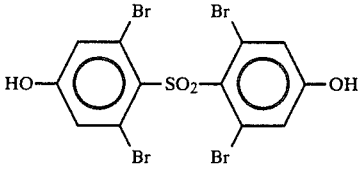

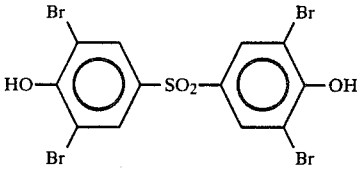

In the present invention, it is preferable that the color developer consisting essentially of the above described first bisphenol derivatives be employed in an amount of 1 to 10 parts by weight, more preferably in an amount of 2 to 6 parts by weight, with respect to 1 part by weight of the leuco dye.

The leuco dyes for use in the present invention are those employed conventionally in the field of thermosensitive recording materials. They can be used alone or in combination.

Examples of such leuco dyes for use in the present invention are triphenylmethane-type leuco compounds, fluoran-type leuco compounds, phenothiazine-type leuco compounds, auramine-type leuco compounds and spiropyran-type leuco compounds.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-dimethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-dimethylamino-7-chlorofluoran,
3-dimethylamino-7-methylfluoran,
3-dimethylamino-7,8-benzofluoran,
3-dimethylamino-6-methyl-7-chlorofluoran,
3-(N-p-tolyl-N-ethylamino)-6-methyl-7-anilinofluoran,
3-pyrrolidino-6-methyl-7-anilinofluoran,
2- N-(3'-trifluoromethylphenyl)amino-6-dimethylaminofluoran,
2- 3,6-bis(dimethylamino)-9-(o-chloroanilino)xanthylbenzoic acid lactam,
3-dimethylamino-6-methyl-7-(m-trichloromethylanilino)fluoran,
3-dimethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran, benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-dimethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-dimethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthylamino-4'-bromofluoran, and
3-diethylamino-6-methyl-7-mesidino-4',5'-benzofluoran.

As mentioned previously, these leuco dyes can be used alone or in combination.

In the present invention, a wide variety of conventional binder agents can be employed for binding and supporting the above-mentioned leuco dyes and color developers. Examples of the binder agents are as follows: polyvinyl alcohol; starch and starch derivatives; cellulose derivatives such as methoxycellulose, hydroxy-ethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

Further in the present invention, auxiliary additive components which are employed in the conventional thermosensitive recording materials, such as fillers, surface active agents and thermo-fusible materials, can be employed.

As the fillers, for example, the following can be employed: inorganic powder such as powder of calcium carbonate, silica, zinc oxide, titanium oxide, aluminium hydroxide, zinc hydroxide, barium sulfate, clay, talc and surface-treated calcium carbonate and silica; and organic powder such as powder of urea-formaldehyde resin, styrene/metacrylic acid copolymer and polystyrene resin.

As the thermo-fusible materials, for example, the following can be employed: higher fatty acids, esters, amides and metallic salts thereof, waxes, condensation products of aromatic carboxylic acids and amines, benzoic acid phenyl ester, higher straight chain glycols, 3,4-epoxy-dialkyl hexahydrophthalide, higher ketones and other thermo-fusible organic compounds with a melting point ranging from about 50° C. to 200° C.

The thermosensitive recording material according to the present invention can be prepared, for example, by applying a thermosensitive coloring layer formation liquid containing the above-mentioned components to an appropriate support material such as paper, synthetic paper or plastic film, followed by drying the applied thermosensitive coloring layer formation liquid. The thus prepared thermosensitive recording material according to the present invention can be employed for recording in a wide variety of fields.

In comparison with the conventional thermosensitive recording materials, the thermosensitive recording material according to the present invention is significantly improved with respect to the fading of recorded images, the whitening thereof caused by the formation of white powder or crystals in the image areas, thermal sensitivity, image density and the preservability of the recorded images.

Referring to the following examples, embodiments of a thermosensitive recording material according to the present invention will now be explained in detail.

EXAMPLE 1

Liquid A, Liquid B and Liquid C were prepared by grinding the respective following components in a ball mill for 72 hours:

| | Parts by Weight |
|---|---|
| Liquid A | |
| 2,2',6,6'-tetrabromo-4,4'-sulfonyl-diphenol | 200 |
| Calcium carbonate | 100 |
| 10% aqueous solution of polyvinyl alcohol | 200 |
| Water | 500 |
| Liquid B | |
| 3-N—methyl-3-N—cyclohexylamino-6-methyl-7-anilinofluoran | 300 |
| 10% aqueous solution of polyvinyl alcohol | 300 |
| Water | 400 |
| Liquid C | |
| 4-hydroxydimethylphthalate | 200 |
| Calcium carbonate | 100 |
| 10% aqueous solution of polyvinyl alcohol | 200 |
| Water | 400 |

Liquid A was applied with a deposition of 4 g/m$^2$ (when dried) to a sheet of high quality paper having a basis weight of 50 g/m$^2$ and was then dried, whereby an under-coated layer was formed on the paper.

10 parts by weight of Liquid B and 40 parts by weight of Liquid C were mixed. This mixture was applied to the undercoated layer with a deposition of the solid components of 2.5 g/m$^2$ when drid (the deposition of the solid components of Liquid B was 0.5 g/m$^2$ when dried), and was then dried to form a thermosensitive color-forming layer thereon, whereby a thermosensitive recording material No. 1 according to the present invention was prepared.

EXAMPLE 2

The procedure of Example 1 was repeated except that the 2,2',6,6'-tetrabromo-4,4'-sulfonyldiphenol in Liquid A was replaced with 2,2-bis(3,5-dibromo-4-hydroxyphenyl)propane, whereby a thermosensitive recording material No. 2 according to the present invention was prepared.

EXAMPLE 3

The procedure of Example 1 was repeated except that 4-hydroxydimethylphthalide employed as the color developer in Liquid C was replaced with 1,7-di(4-hydroxyphenylthio)-3,5-dioxaheptane

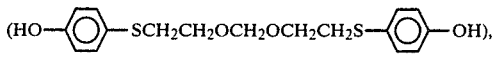

whereby a thermosensitive recording material No. 3 according to the present invention was prepared.

EXAMPLE 4

The procedure of Example 3 was repeated except that the 2,2',6,6'-tetrabromo-4,4'-sulfonyldiphenol in Liquid A was replaced with 2,2-bis(3,5-dibromo-4-hydroxyphenyl)propane, whereby a thermosensitive recording material No. 4 according to the present invention was prepared.

COMPARATIVE EXAMPLE 1

40 parts by weight of Liquid A, 10 parts by weight of Liquid B and 40 parts of Liquid C were mixed. This mixture was applied to a sheet of high quality paper having a basis weight of 50 g/m$^2$ with a deposition of the solid components of 4.4 g/m$^2$when dried (the deposition of the solid components of Liquid B was 0.5 g/m$^2$ when dried), and was then dried, whereby a comparative thermosensitive recording material No. 1 was prepared.

COMPARATIVE EXAMPLE 2

The procedure of Comparative Example 1 was repeated except that 10 parts by weight of Liquid B and 40 parts by weight of Liquid C were mixed, without containing Liquid A, whereby a comparative thermosensitive recording material No. 2 was prepare.

COMPARATIVE EXAMPLE 3

The procedure of Comparative Example 1 was repeated except that 4-hydroxydimethylphthalide in Liquid C was replaced with 1,7-di(4-hydroxyphenylthio)-3,5-dioxaheptane

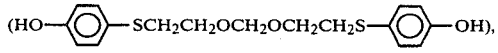

whereby a comparative thermosensitive recording material No. 3 was prepared.

The thermosensitive recording materials No. 1 through No. 4 according to the present invention and the comparative thermosensitive recording materials No. 1 through No. 3 were subjected to dynamic thermal coloring sensitivity tests, image fading tests, and visual inspection of the formation printed images was measured by use of a Macbeth densitometer RD-514 with a filter W-106 attached thereto.

The dynamic thermal coloring sensitivity tests were conducted by performing thermal printing on each of the above thermosensitive recording materials by a thermal printing experiment apparatus having a thin-film thermal head (commercially available by Matsushita Electronic Components Co., Ltd.), with application of electric power of 0.45 W/dot to the thermal head for a recording time of 20 ms per line, and with a scanning line density of 8×3.85 dots/mm, with the pulse width thereof being changed to 1.0, 1.2, 1.4, 1.6, 1.8 and 2.0 msec. The density of each printed image was measured by use of a Macbeth densitometer RD-514 with a filter W-106 attached thereto.

The thermosensitive recording material samples with printed images having an image density ranging from 1.0 to 1.2 (which were obtained in the above dynamic thermal coloring sensitivity tests) were subjected to image fading tests by allowing the samples to stand at room temperature for 15 days.

The image fading degree was determined in accordance with the following formula:

$$\text{Image Density Decreasing Ratio} = \frac{D_0 - D}{D_0} \times 100\%$$

where $D_0$ is the initial density of a printed image and D is the image density after 15 days in the above tests.

The visual inspection of the formation of white powder or crystals in the recorded image areas was performed by allowing each sample obtained in the dynamic thermal coloring sensitivity tests to stand at room temperature for 15 days as in the image fading tests.

The formation of white powder or crystals in the recoded image areas was visually inspected. The results of the above-mentioned tests are summarized in the following table.

TABLE 1

| | Dynamics Thermal Coloring Sensitivity | | | | | | Image Fading Ratio | Whitening of Recorded Images |
|---|---|---|---|---|---|---|---|---|
| | 1.0 ms | 1.2 ms | 1.4 ms | 1.6 ms | 1.8 ms | 2.0 ms | | |
| Example 1 | 0.55 | 0.82 | 1.08 | 1.20 | 1.30 | 1.35 | 6% | o |
| Example 2 | 0.58 | 0.85 | 1.10 | 1.20 | 1.33 | 1.36 | 8% | o |
| Example 3 | 0.55 | 0.83 | 1.08 | 1.21 | 1.31 | 1.35 | 6% | o |
| Example 4 | 0.56 | 0.85 | 1.10 | 1.21 | 1.30 | 1.36 | 8% | o |
| Comparative Example 1 | 0.30 | 0.55 | 0.80 | 1.00 | 1.10 | 1.20 | 5% | o |
| Comparative Example 2 | 0.50 | 0.79 | 1.03 | 1.18 | 1.25 | 1.30 | 40% | x |
| Compara- | 0.31 | 0.55 | 1.11 | 1.00 | 1.11 | 1.20 | 5% | o |

TABLE 1-continued

| | Dynamics Thermal Coloring Sensitivity | | | | | | Image Fading Ratio | Whitening of Recorded Images |
|---|---|---|---|---|---|---|---|---|
| | 1.0 ms | 1.2 ms | 1.4 ms | 1.6 ms | 1.8 ms | 2.0 ms | | |
| tive Example 3 | | | | | | | | |

Note:
o: Almost no white powder or crystals were formed in the recorded image areas.
x: White powder or crystals were so much formed in the recorded image areas that the thermosensitive recording material cannot be used in practice.

As can be seen from the results shown in the above table, the thermosensitive recording materials according to the present invention are improved with respect to the dynamic thermal coloring sensitivity, the image fading degree and the whitening of the recorded images, in comparison with the comparative thermosensitive recording materials.

What is claimed is:

1. In a thermosensitive recording material comprising a support material and a thermosensitive color-forming layer formed on said support material, said thermosensitive color-forming layer comprising a colorless or light-colored leuco dye and a color developer capable of inducing color formation in leuco dye upon application of heat thereto, the improvement wherein said color developer is 4-hydroxydimethylphthalate or a first bisphenol derivative of the formula (I),

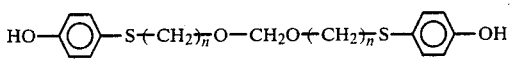

(I)

wherein n is an integer of 1 or 2, and there is interposed between said support material and said thermosensitive color-forming layer an under-coated layer comprising a second bisphenol derivative of the formula (II),

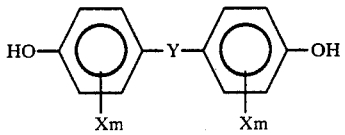

(II)

wherein X represents halogen, Y represents —$SO_2$— or —

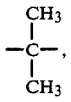

m is an integer of 1 or 2, and the substitution positions of Xm in the benzene rings are symmetrical with respect to Y.

2. A thermosensitive recording material as claimed in claim 1, wherein the amount of said color developer is in the range of 1 to 10 parts by weight with respect to 1 part by weight of said leuco dye.

3. A thermosensitive recording material as claimed in claim 1, wherein said leuco dye is selected from the group consisting of triphenylmethane-type leuco compounds, fluoran-type leuco compounds, phenothiazine-type leuco compounds, auramine-type leuco compounds and spiropyran-type leuco compounds.

4. A thermosensitive recording material as claimed in claim 1, wherein said first bisphenol derivative of the formula (I) is selected from the group consisting of 1,7-di(4-hydroxyphenylthio)-3,5-dioxaheptane and 1,5-di(4-hydroxyphenylthio)-2,4-dioxapentane.

5. A thermosensitive recording material as claimed in claim 1, wherein said second bisphenol derivative of the formula (II) is selected from the group consisting of

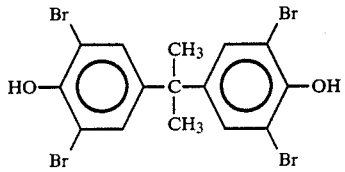

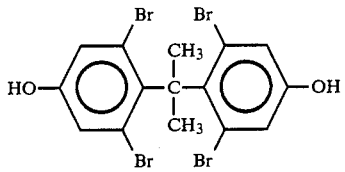

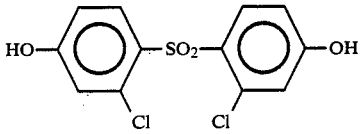

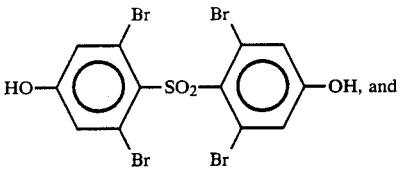

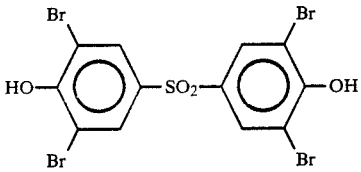

* * * * *